United States Patent [19]

Gartner

[11] Patent Number: 4,910,981

[45] Date of Patent: Mar. 27, 1990

[54] AUTOMATICALLY LOCKING AND TUMBLER SCRAMBLING MANIPULATION PROOF LOCK

[76] Inventor: Klaus W. Gartner, 2632 Via Anacapa, Palos Verdes Estates, Calif. 90274

[21] Appl. No.: 325,457

[22] Filed: Mar. 17, 1989

[51] Int. Cl.[4] ..... E05B 37/00

[52] U.S. Cl. ..... 70/314; 70/303 A; 70/322

[58] Field of Search ..... 70/314, 303 R, 303 A, 70/322, DIG. 52, DIG. 53, DIG. 54, DIG. 55

[56] References Cited

U.S. PATENT DOCUMENTS

| | | | |
|---|---|---|---|
| 1,845,021 | 2/1932 | Hope | 70/314 |
| 3,481,167 | 12/1969 | Barner | 70/314 |
| 4,142,388 | 3/1979 | Phillips | 70/316 |
| 4,541,259 | 9/1985 | Oyeda | 70/316 |
| 4,756,176 | 7/1988 | Oyeda | 70/303 A |

*Primary Examiner*—Robert L. Wolfe

*Attorney, Agent, or Firm*—Poms, Smith, Lande & Rose

[57] ABSTRACT

An automatically self locking and self scrambling combination lock is disclosed wherein a spring biased bolt is moveable by its bias toward a locking position and a detent is provided on an end of the fence arm associated with a fence lever connected to the bolt whereby on movement of the bolt towards its locking position, the detent engages the edge of a single one of the tumbler wheel gates to scramble that tumbler wheel alignment relative the other tumbler wheels as the fence arm leaves the tumbler wheel gates. Additional spring means are provided in the form of a multiple armed spring member having a first spring arm which urges the fence lever toward the tumbler wheels when the spring member is deflected under the action of an actuator roller once on each rotation of an associated lock shaft, a second spring arm which normally urges the fence lever away from the tumbler wheels when the spring member is not deflected and a third spring arm which normally biases the spring member toward its non-deflected position of rest. In addition, an eccentric roller rim associated with the actuator roller for deflecting the spring member is provided so that the timing of such defective movement of the spring member in response to rotation of the lock shaft varies from rotation to rotation in response to incremental movements of the eccentric rim about its mounting post as it goes through successive engagements with the spring member.

24 Claims, 3 Drawing Sheets

AUTOMATICALLY LOCKING AND TUMBLER SCRAMBLING MANIPULATION PROOF LOCK

BACKGROUND OF THE INVENTION

The present invention relates in general to manually operated combination locks having a plurality of tumbler wheels with associated tumbler wheel gates which must be aligned to operate the lock and more particularly to such a lock which is adapted to scramble the alignment of such tumbler wheels automatically in response to a locking motion of the associated lock bolt and bolt operating fence lever.

Manually operated combination locks are generally well known as disclosed in prior U.S. Pat. Nos. 4,541,259 entitled "COMBINATION LOCK" and U.S. Pat. No. 4,142,388 entitled "TUMBLER WHEELS FOR COMBINATION LOCKS" by way of example. It is common, in such locks, to provide a plurality of tumbler wheels having gates therein which must be aligned through manipulation of an associated lock dial and shaft associated with the tumbler wheels in order to allow a fence arm to enter the gates, the fence arm being connected by a fence lever to the lock bolt. Once the fence arm enters the tumbler wheel gates, as is known in the art, the fence lever is released from constraining means to facilitate withdrawal of the lock bolt by further rotation of the dial and its associated shaft. The manipulation of the lock bolt between locking and unlocking positions may be accomplished in response only to rotation of the associated dial and shaft or, as disclosed in U.S. Pat. No. 4,541,259, may be biased toward a locking position when the dead bolt is operated instead as a spring bolt. However, in said '259 patented lock, the dead bolt, whether operated as a true dead bolt or as a spring bolt, does not cooperate with the lock mechanism in any manner to scramble the alignment of the tumbler wheels when the lock is returned to its lock position. It is thus possible in prior combination lock constructions to close a safe door, security door or other structure to be protected by such a lock and, unless the dial is turned to scramble the tumbler wheels, the lock remains in an unlocked condition. This can be particularly a problem where in commercial establishments, staff do not wish to go through the trouble of entering a combination and prefer to close a safe or other security door in an apparently locked condition but do not turn the dial to scramble the tumblers to cause the lock to achieve a truly locked condition. Because of the possibility of such intentional, as well as many unintentional, failures to cause complete locking of a dead bolt combination lock having a plurality of tumbler wheels as discussed hereinbefore, it is the primary object of the present invention to disclose and provide an improved self locking and self scrambling combination lock.

SUMMARY OF THE INVENTION:

In view of the foregoing, it is primary object of the present invention to disclose and provide an automatically self locking and self scrambling combination lock wherein a plurality of tumbler wheels are employed which have individual tumbler wheel gates which are aligned to one another during the unlocking sequence of manipulation of the lock. It is a further object of the present invention to disclose and provide such a self locking and self scrambling combination lock which is easily manufactured and reliably operated in the same manner as prior similar combination locks but which produces automatically the self locking and self scrambling features noted with a minimum of additional mechanisms or alterations to prior lock constructions.

Generally stated, the present invention in an automatically self locking and self scrambling combination lock includes the provision of a spring biased bolt moveable by its bias t a locking position, a fence lever associated with such spring bias bolt for moving it against such bias to an unlocking position and a plurality of tumbler wheels, each having a fence receiving gate, whereby a predetermined manipulation of the tumbler wheels in accordance with a predetermined combination is required to align the gates, allow the fence lever to enter the gates and thereafter allow manipulation of the lock to withdraw the bolt. The lock thus being automatically self locking; tumbler engaging means are associated with the fence lever for moving one of the aligned tumbler wheels relative other ones thereof to scramble the alignment of the wheels in response to movement of the fence lever as it is withdrawn from the gates under the bias of the bolt moving to its locking position.

More specifically, the present invention in automatic self locking and self scrambling combination lock as aforedescribed includes a detent as part of the tumbler engaging means which is provided upon the fence arm for engaging an edge of one of the gates of one of the tumbler wheels as the arm exits from such gate. An additional spring is provided to urge the fence lever to move outwardly of the gate as the bias of the bolt moves the bolt and associated fence lever toward the bolt locking position and a constraint is provided against which the lever operates within a predetermined arcuate movement as it is biased outwardly of the gate by the additional spring and pulls the gate and wheel in a rotational motion thereof as the bolt is biased toward its locking position.

As a further feature of the within invention, a multiple arm spring member is pivotally mounted to a stationary mounting associated with the lock, has a pair of first and second spring arms associated with the fence lever for biasing it toward and away from the tumbler wheels and a follower arm provided in the path of rotation of a roller actuator mounted to a cam disc fixed to an inner end of the lock shaft rotated by manipulation of a dial associated with the lock. The first spring arm biases the fence lever toward the gates of the tumbler wheels when the roller actuator pivots the spring member toward a deflected position which is resisted by an integral third spring arm thereof which abuts apportion of the lock housing. The second spring arm normally biases the fence lever away from the gates of the tumbler wheels when the spring member is not in the deflected position. Once on each rotation of the dial and its associated shaft, the roller actuator deflects the spring member and biases the fence lever toward to the tumbler wheel gates, release of the spring member by the actuator allowing the spring member to then bias the lever away from the tumbler gates, a feature which is particularly important in the self scrambling feature of the lock as described hereinbefore.

As a still further feature of the present invention the roller actuator, mounted on a cam disc associate with the dial shaft, is constructed of a roller rim eccentrically mounted about a support pin which itself is mounted eccentrically of the center of rotation of the cam disc. Once on each rotation of the dial and lock shaft, when the roller actuator engages the spring member, and specifically a follower arm formed integrally thereof, the eccentrically mounted roller rim moves slightly relative to its circular post mounting. Thus, the timing of the engagement between the roller actuator and the spring member follower arm varies minutely and variably on successive rotations of the dial and lock shaft in a manner to enhance the anti-manipulation characteristics of the lock.

A more complete understanding of the present invention in an automatically self locking and self scrambling combination lock, as well as the realization of additional objects and advantages thereof, will be afforded to those skilled in the art from a consideration of the following detailed description of a preferred exemplary embodiment thereof. Reference will be made to the appended sheets of drawings which will be first briefly described.

DETAILED DESCRIPTION OF A PREFERRED EXEMPLARY EMBODIMENT

Figure 1:
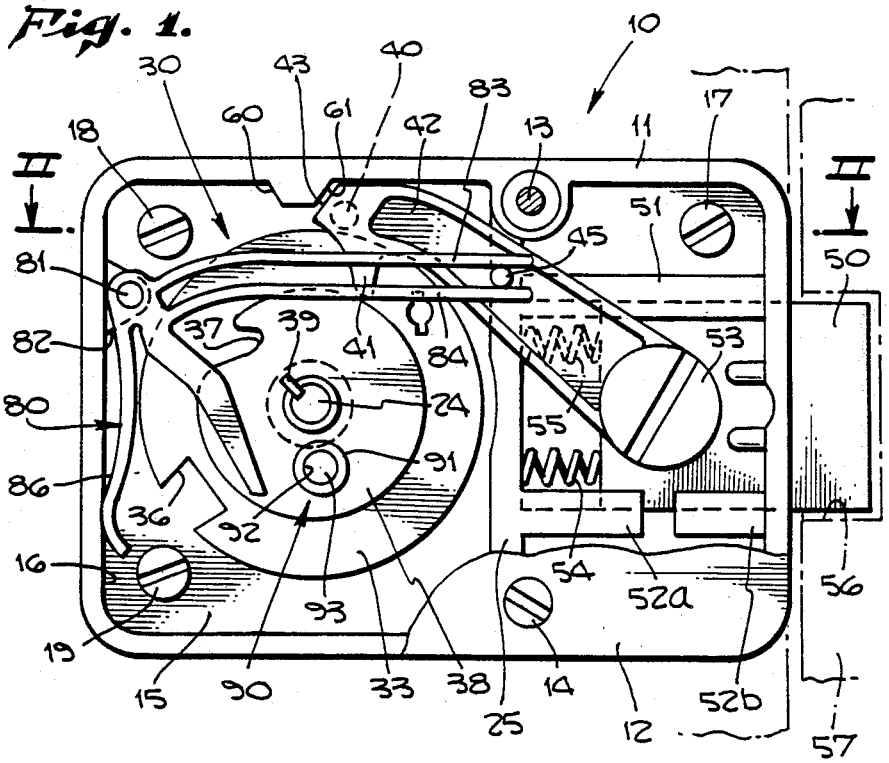
FIG. 1 is a plane view of an exemplary embodiment of automatic self locking and self scrambling combination lock, with portions of the rear cover removed, according to the present invention.
Figure 2:
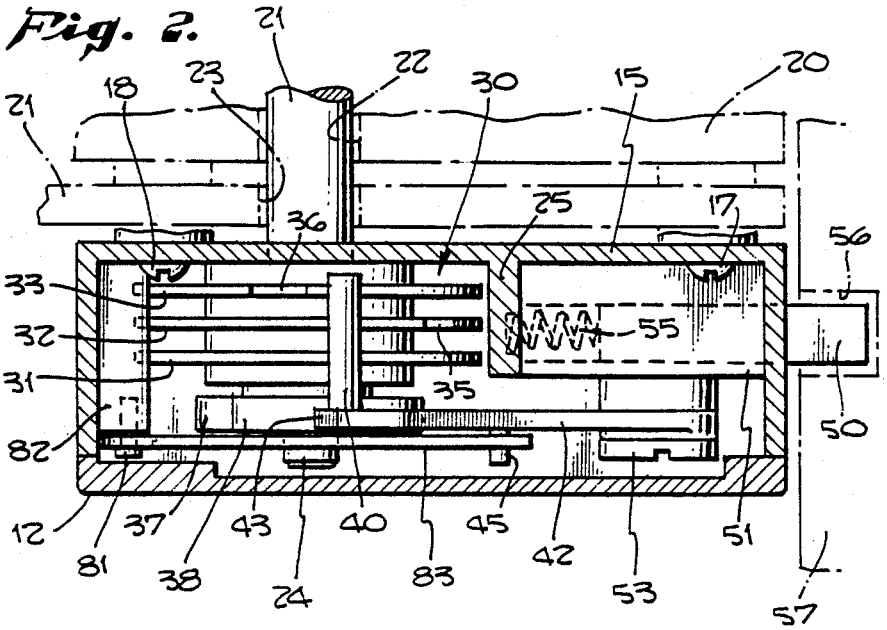
FIG. 2 is a section view through the exemplary embodiment of lock of FIG. 1 taken therein along the plane II—II.

Referring now to FIGS. 1 and 2 initially, an exemplary embodiment of automatically self locking and self scrambling combination lock, in accordance with the present invention, will now be described in detail.

As seen in FIGS. 1 and 2, the exemplary lock is provided with a lock housing, indicated generally at 10 which comprises a box like base 11 which is normally closed by cover plate 12, the latter being secured to base 11 by appropriate fasteners 13 and 14 which may be simple machine screws. Base 11 has a bottom wall 15 and a surrounding side wall 16. The lock mechanism as subsequently described is enclosed within the housing thus provided. The housing is preferably mounted on the inside of a security door or safe door by means of mounting screws, such as screws 17, 18 and 19 as seen in FIGS. 1 and 2. The security or safe door 20 may be provided with a hardened plate 21 as is known in the industry, inwardly of the door to protect the lock against drilling etc. As seen in FIG. 2, a lock shaft 21 is provided in conventional manner for mounting a combination lock dial and extends through the bores 22 and 23 through the door 20 and hardened plate 21 where it passes through the rear wall 15 of lock housing base 11 to mount a plurality of tumbler heels, indicated generally at 30.

The exemplary tumbler wheels, indicated generally at 30, may be provided as disclosed in U.S. Pat. No. 4,142,388, entitled "TUMBLER WHEELS FOR COMBINATION LOCKS" issued to Peter J. Phillips on Mar. 6, 1979 and/or as disclosed in prior U.S. Pat. No. 4,541,259 entitled "COMBINATION LOCK" which issued to Tim M. Uyeda on Sept. 17, 1985. As is now well known in the industry such tumbler wheels are manipulated through rotation of lock shaft 21 in order to enter a predetermined lock combination, the tumbler wheels being provided with individual gates, as tumbler wheel gates 34, 35 and 36 in the tumbler wheels 31, 32 and 33 respectively. When the gates 34, 35 and 36 are aligned, a fence arm 4 may enter the same to allow the nose 41 on fence lever 42 to enter cam slot 37 on cam disc 38, the latter being fixed by stake 39 to a reduced diameter stub shaft 24 which is an extension of shaft 21. Rotation of shaft 21 with fence lever nose 41 in slot 37 facilitates opening the bolt as will know be described.

The lock bolt 50, as seen in FIGS. 1 and 2 is mounted for sliding movement inwardly and outwardly of the lock housing via the channel shaped upper and lower guides 51 and 52, the lower guide being interrupted into two parts **52*a* and 52*b* to facilitate assembly of the lock bolt and its associated components. Fence lever 22 is provided with connecting means to the bolt for a pivotal connection therebetween, the exemplary embodiment comprising the retainer screw 53 which pivotally holds the lower end of lever 42 to a side of bolt 50** in known manner.

As a feature of the present invention, the bolt 50, which in normal combination lock situations comprises a dead bolt which is thrown only through manipulation of the lock shaft 21, is provided with a bias which normally urges it toward the locking position of FIGS. 1 and 2. In the exemplary embodiment, such bias is provided by the springs 54 and 55 which have their opposite ends set in appropriate bores provided in the housing web 25 and bolt 50 as seen in the drawings. In the present exemplary embodiment of lock, therefor, as opposed to normal dead bolt lock mechanisms of the prior art, the bolt 50 is biased toward a locking position.

As is particularly contemplated within the present invention, tumbler engaging means are associated with the fence lever for moving one of the aligned tumbler wheels relative other ones thereof to scramble the alignment of the tumbler wheels in response to movement of the fence lever as it is drawn along under the bias of bolt 50 toward its lock position of FIGS. 1 and 2 as will now be described.

Figure 3:
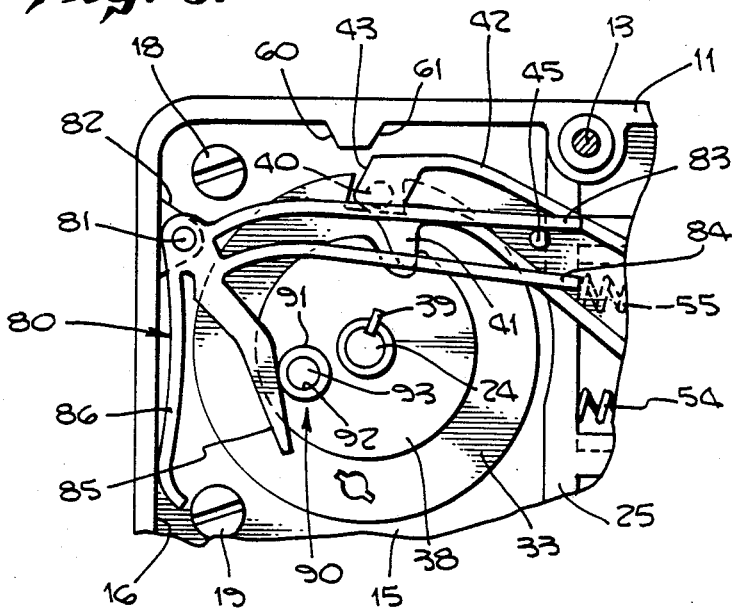
FIG. 3 is a detailed vie of a portion of the lock of FIG. 1 showing the exemplary fence lever received within gates of exemplary tumbler wheels as occurs during an unlocking manipulation of the lock.
Figure 4:
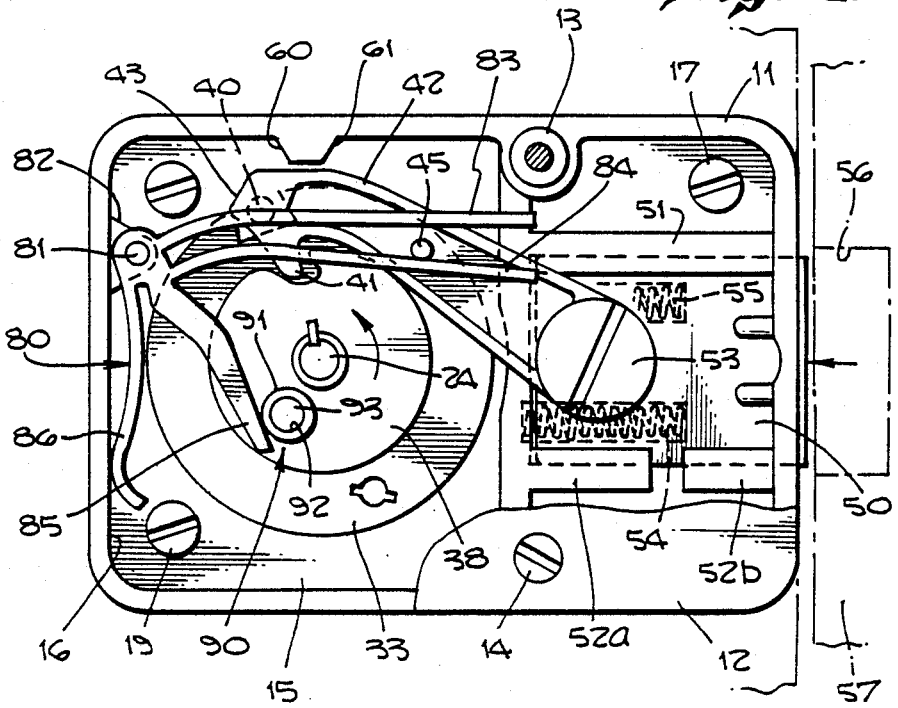
FIG. 4 is a view as in FIG. 3 showing the tumbler wheels, fence lever and bolt moved to an unlocking position.

In order to open the lock, the tumbler wheels 31, 32 and 33 must be manipulated through successive opposite rotational movement of shaft 21, in a manner known in the industry, to leave the tumbler wheels in selected locations wherein each of the gates 34, 35 and 36 are aligned to one another. Biasing means, as subsequently described, normally urge fence lever 42 toward the tumbler wheels so that when the gates are aligned the fence arm 40 enters the gates as seen in FIG. 3. Rotation of shaft 21 and its associated stub shaft 24 rotates the cam disc 38 counterclockwise in FIGS. 3 and 4 to draw fence lever by its nose 41 under the constraining means 60, the latter having constraining surface 61 which is normally engaged by lever end surface 43 to prevent opening of the lock bolt until the fence lever 40 is received within the gates, as seen in FIG. 1. As seen in FIG. 4, movement of fence lever 42 under constraining means 60 withdraws bolt 50 from the receptacle 56 which may be part of safe door jam, security door jam or the bolt works within a security or safe door which in turn operates door bolts.

Figure 5:
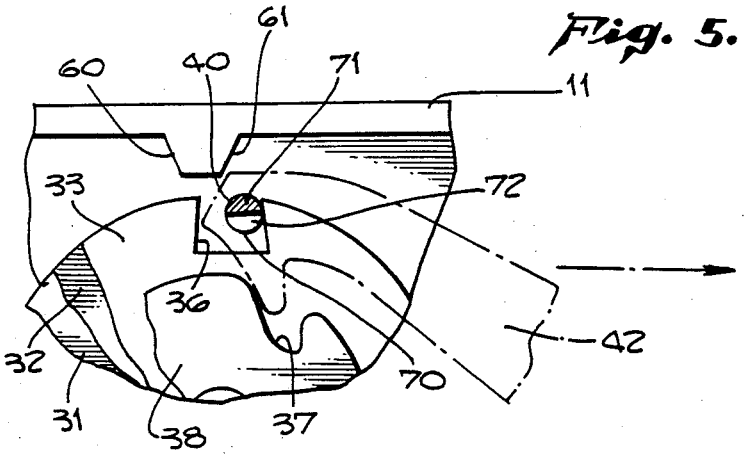
FIG. 5 is a detailed view of a portion of the exemplary tumbler wheels and fence lever of FIGS. 1 through 4 showing the associated fence arm engaging sides of the gates of the exemplary tumbler wheels during a locking motion of the bolt.
Figure 6:
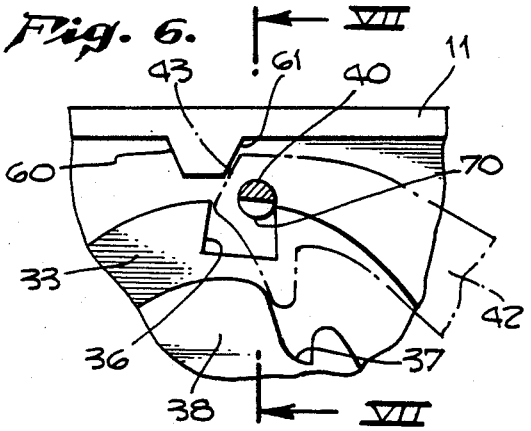
FIG. 6 is a view as in FIG. 5 showing the release of the fence arm from some of the gates while a detent provided on the fence arm engages a side wall of one of the gates of one of the tumbler wheels in order to scramble its orientation relative the other tumbler wheels as the fence arm is withdrawn from the gates.
Figure 7:
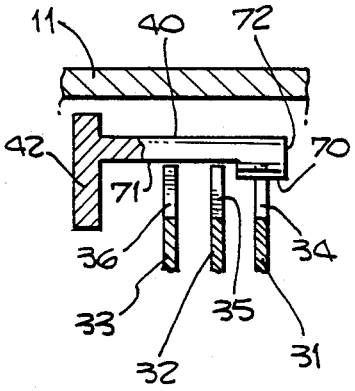
FIG. 7 is a vertical section view through the fence arm and tumbler wheels of FIG. 6 taken therein along the plane VII—VII.
Figure 8:
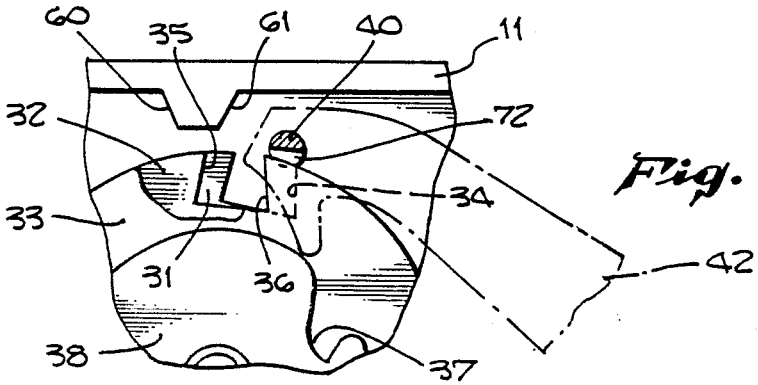
FIG. 8 is a view as in FIGS. 5 and 6 showing the fence arm and associated detent moving said one of said tumbler wheels into a scrambled position out of alignment with the other tumbler wheels.

In the exemplary embodiment, the tumbler engaging means for scrambling one of the tumbler wheels relative the others during locking movement of the bolt 50 includes the provision of a detent 70 as best seen on FIG. 7, on an end of fence ar 40. As seen in section in FIG. 5, fence arm 40 may have a semi-circular configuration as indicated at 71 in FIG. 5 as it extends from lever 42 and have a full circular cross-section as indicated at 72 at its outer end to provide the detent 70. As seen in FIG. 5, as fence arm 40 is raised by a spring bias, as subsequently described, during a bolt locking motion the half circular portion 71 of arm 40 clears the edges of gates 35 and 36 as seen in FIGS. 6 and 7 before the detent 70 clears the last gate 34 of tumbler wheel 31 as seen in FIG. 8, such continued engagement moving tumbler 31 relative tumbler wheels 32 and 33 to scramble the relative alignment thereof during the locking motion of bolt 50 and the associated fence lever 42 as seen in FIGS. 5 through 8. As is also seen in FIGS. 5 through 8, the constraining means 60 limits movement of the lever 42 and consequently detent 70 to ensure engagement between detent 70 and gate 34 of tumbler wheel 31 as seen in FIG. 6 due to the constraint of cam surface 61 against lever end surface 43 as seen in FIG. 6.

In order for the fence lever 42 to be alternately biased toward the tumbler wheels during the bolt unlocking movement from FIG. 1 to FIG. 4 and to be biased away from the tumbler wheels during the bolt locking movement as the bolt moves from the position of FIG. 4 back to FIG. 1, and the detent 70 engages gate 34 of tumbler wheel 31 under the constraining action of constraining means 60 as seen in FIGS. 5 through 8, and as is also particularly contemplated within the scope of the present invention, improved biasing means are provided for effecting the aforestated bias upon lever 42 and lever arm 40 as now will be described in detail.

In the exemplary embodiment, such biasing means is provided by a multiple arm spring member, indicated generally at 80, which is pivotally mounted by pin 81 to mounting boss 82 provided integrally of housing base 11 as seen in FIGS. 1 through 4. A first spring arm 83 provides an additional spring means for urging the fence lever 42 and fence arm 40 toward the tumbler wheels when bolt 50 is in the locking position of FIGS. 1 and 2, spring arm 83 normally riding on top of the abutment pin 45 provided on a lever 42. A second spring arm 84 is provided as an integral part of the spring member, indicated generally at 80, which, as seen in FIGS. 1 through 4, underlies abutment pin 45 on the fence lever 42 to provide an additional spring means, in addition to springs 54 and 55, for urging the fence lever 42 to move the fence arm 40 outwardly of the gates 34, 35 and 36 as the bolt is moved by the bias of springs 54 and 55 toward a bolt locking position as seen in FIGS. 1 and 2. Spring arm 84, and its additional spring means thus provided, is important to lift the fence arm 40 out of the gates as the bias of bolt 50 moves the lever from below the constraining means 60 as seen in FIG. 4 to the position of FIG. 5. Moreover, the presence of spring 84 urges the fence arm 40 to move in a constrained arcuate movement upwardly along the surface 61 of the constraining means 60 as the bolt moves to its locking position to first leave the gates 35 and 36 and then drag detent 70 across the corner of the top edge of gate 34 as seen in FIG. 8 to scramble the tumbler wheels.

The spring arms 83 and 84 are provided to normally lie in parallel spaced relation on opposite sides of abutment pin 45 as seen in FIG. 1. In order to actuate the bias of upper arm 83, a roller actuator, indicated generally at 90 is mounted on cam disc 38 to revolve with and eccentrically of stub shaft 24 as the lock shaft 21 is rotated. Once upon each rotation of shaft 21, and its associated stub shaft 24, the roller actuator indicated generally at 90, comes into engagement with the follower arm 85 which is formed integrally of the multiple arm spring member indicated generally at 80. As seen from a comparison of FIGS. 1 and 3, rotation of shafts 21 and 24 causes the actuator roller, indicated generally at 90, to engage actuator arm 85 and deflect the spring member to cause the upper spring arm 83 to bias the fence lever 42 and its fence arm 40 toward the tumbler wheels and tumbler wheel gates as seen in FIG. 3 once upon each rotation of shafts 21 and 24. This deflective movement of the multiple arm spring member, indicated generally at 80, is resisted by a third integral spring arm 86 which, as seen in FIGS. 1, 3 and 4 is provided to abut against an inner surface of housing side walls 16 to normally position the spring member, indicated generally at 80, in a normal position of rest as seen in FIG. 1. Once upon each rotation of shafts 21 and 24 in either direction, the roller actuator, indicated generally at 90, causes the spring member, indicated generally at 80, to deflect to the deflected position of FIG. 3 to bias the lever 42 and its lever arm 40 toward the tumbler wheels and gates as discussed.

As is also particularly contemplated within an aspect of the present invention, the timing of the engagement between the roller actuator, indicated generally at 90, and the follower arm 85 of the multiple arm spring member is adjusted through the provision of a roller rim 91 which is mounted by an eccentrically formed bore 92 by which rim 91 is rotatably mounted to circular mounting pin 93. Upon each engagement between roller rim 91 and actuator arm 85, the ri 91 moves in a rotational motion in small random increments relative mounting post 93. Since the thickness of rim 91 relative the post 93 varies about the circumference of the mounting post 93 due to the eccentric mounting of rim 91 to post 93, the exact point of contact between the roller rim 91 and actuator arm 85 on successive rotations of lock shaft 21 and its associated stub shaft 24 vary from rotation to rotation. There is thus an advantage in the anti-manipulation aspects of the present lock in providing for a variation in a random manner of the timing of the engagement of the roller actuator with the follower arm to operate the fence lever toward the tumbler wheels and the associated tumbler wheel gates on successive rotations of the lock shaft.

Having thus described a preferred exemplary embodiment of an automatically self locking and self scrambling combination lock in accordance with the present invention, it should now be apparent to those skilled in the art from a consideration of the foregoing that various advantages and objects have been attained and enhanced lock security afforded by the within invention which is limited only by the following claims.

I claim:

1. An automatically self locking and self scrambling combination lock including a spring biased bolt moveable by its bias to a locking position, fence lever means associated with said bolt for moving it against its bias to an unlocking position and a plurality of tumbler wheels, each having a fence receiving gate, whereby a predetermined manipulation of said tumbler wheels to align the gates thereof is required to release said fence lever means for manipulation thereof to withdraw said bolt, said lock comprising:

tumbler engaging means associated with said fence lever means for engaging and moving one of said aligned tumbler wheels relative other ones thereof to scramble the alignment of said one of said wheels relative said other ones of said wheels in response to movement of said fence lever means as said bolt moves under its bias to its locking position.

2. The automatically self locking and self scrambling combination lock of claim 1 wherein said fence lever means includes a fence arm provided to enter the individual gates of said tumbler wheels when the same are aligned to one and said tumbler engaging means comprises:

a detent provided on said fence arm for engaging an edge of the one gate of said one of said tumbler wheels as said arm exists from said one gate.

3. The automatically self locking and self scrambling combination lock of claim 2 wherein said tumbler engaging means further comprises:

additional spring means for urging said fence lever means to move said fence arm outwardly of said gates as the bias of said bolt moves said bolt and fence lever means to said bolt locking position.

4. The automatically self locking and self scrambling combination lock of claim 3 wherein said tumbler engaging means further comprises:

camming means for constraining the outward movement of said fence arm to a predetermined arcuate movement as it is biased outwardly of said one gate by said additional spring means and said fence lever means moves with said spring bolt under its bias towards said locking position whereby said detent is maintained in engagement with said edge of said one gate to move it relative said other ones of said tumbler wheels automatically on movement of said bolt to its locking position.

5. An automatically self locking and self scrambling combination lock including a spring biased bolt moveable by its bias to a locking position, fence lever means associated with said bolt for moving it against its bias to an unlocking position and a plurality of tumbler wheels, each having a fence receiving gate, whereby a predetermined manipulation of said tumbler wheels to align the gates thereof is required to release said fence lever means for manipulation thereof to withdraw said bolt, said lock comprising:

tumbler engaging means associated with said fence lever means for moving one of said aligned tumbler wheels relative other means thereof to scramble the alignment thereof in response to movement of said fence lever means as said bolt moves under its bias to its locking position;

said fence lever means includes a fence arm provided to enter the individual gates of said tumbler wheels when the same are aligned;

said tumbler engaging means comprises a detent provided on said fence arm for engaging an edge of the one gate of said one of said tumbler wheels as said arm exits from said one gate and additional spring means for urging said fence lever means to move said fence arm outwardly of said gates as the bias of said bolt moves said bolt and fence lever means to said bolt locking position; and wherein said lock includes a roller actuator which revolves with rotation of an associated lock shaft which is rotated to operate the fence lever means to withdraw said bolt and said additional spring means comprises:

a multiple arm spring member pivotally mounted to a stationary mounting associated with said lock, said spring member having:

a follower arm provided in the path of rotation of said roller actuator to engage and pivot said spring member into a defected position relative said roller actuator once per rotation of said shaft;

a first spring arm associated with said fence lever means to bias said fence lever toward said gates when said roller actuator actuates pivots said spring member toward said deflected position; and a second spring arm associated with said fence lever means to normally bias said fence lever away from said gates when said spring member is not in said deflected position.

6. The automatically self locking and self scrambling combination lock of claim 5 wherein said addition spring means further comprises:

a third spring arm provided to bias said spring member into a normal position of rest from which it is defected by operation of said roller actuator, the bias of said third spring serving to return said spring member to its position of rest after said roller actuator disengages said follow arm.

7. The automatically self locking and self scrambling combination lock of claim 5 wherein said fence lever means includes an abutment member and said addition spring means first and second spring arms lie an opposite sides of said abutment member and engage said abutment member from said opposite sides to provide said bias to said fence lever means toward and away from said gates.

8. The automatically self locking and self scrambling combination lock of claim 5 wherein:

said spring member is provided as a one piece member having said follower, first, second and third arms integral of one another.

9. An automatically self locking and self scrambling combination lock including a spring biased bolt moveable by its bias to a locking position, fence lever means associated with said bolt for moving it against its bias to an unlocking position and a plurality of tumbler wheels, each having a fence receiving gate, whereby a predetermined manipulation of said tumbler wheels to align the gates thereof is required to release said fence lever means for manipulation thereof to withdraw said bolt, said lock comprising:

tumbler engaging means associated with said fence lever means for moving one of said aligned tumbler wheels relative other ones thereof to scramble the alignment thereof in response to movement of said fence lever means as said bolt moves under its bias to its locking position, and wherein said locking includes a roller actuator which revolves with rotation of an associated lock shaft which is rotated to operate said fence lever means to withdraw said bolt and wherein:

said roller actuator is provided with a rim eccentrically mounted and rotatable relative to a mounting means which revolves with said shaft whereby rotation of said pin relative said mounting means varies the timing of successive operations of said fence lever means by said roller actuator.

10. A combination lock having a plurality of tumbler wheels, each having a fence arm receiving gate, operated by a manually rotated lock shaft having a cam disc for manipulating the lock bolt via a fence lever, said lock comprising:

biasing means for biasing said bolt toward a locking position;

connecting means for pivotally connecting said fence lever to said bolt;

constraining means for limiting bolt unlocking movement of said fence lever in a lever constrained position until said tumbler wheel gates are aligned and allow movement of said fence lever past said constraining means; and a detent means associated with said fence lever for engaging and moving one of said tumbler wheels relative other ones of said wheels to scramble the alignment of said one of said gates relative other ones of said gates as said bolt moves to said locking position under its bias and said fence lever is moved back to its constrained position.

11. The combination lock of claim 10 wherein said fence lever has an abutment member spaced thereon from said connecting means and said lock comprises:

additional biasing means for biasing said fence lever toward said tumbler wheels and gates when said lever is in said constrained position and for biasing said fence lever away from said tumbler wheels and gates when it is moved past said constrained means.

12. A combination lock having a plurality of tumbler wheels, each having a fence arm receiving gate, operated by a manually rotated lock shaft having a cam disc for manipulating the lock bolt via a fence lever, said lock comprising:

biasing means for biasing said bolt toward a locking position;

connecting means for pivotally connecting said fence lever to said bolt;

constraining means for limiting bolt unlocking movement of said fence lever in a lever constrained position until said tumbler wheel gates are aligned and allow movement of said fence lever past said constraining means;

a detent means associated with said fence lever for moving one of said tumbler wheel relative other ones of said wheels to scramble the alignment of said gates as said bolt moves to said locking position under its bias and said fence lever is moved back to its constrained position; and said fence lever has an abutment member spaced thereon from said connecting means and said lock comprises additional biasing means for biasing said fence lever toward said tumbler wheels and gates when said lever is in said constrained position and for biasing said fence lever away from said tumbler wheels and gates when it is moved past said constrained means; and wherein said additional biasing means comprises a one piece multiple armed spring member having a pair of parallel spaced spring arm lying on opposite sides of said abutment member.

13. The combination lock of claim 12 wherein said spring member further comprises:

a follower arm to be engaged by an actuator member revolving with said shaft to engage and deflect said spring member to urge one of said parallel spring arms against said abutment member to bias said fence lever toward said tumbler wheels and gates.

14. The combination lock of claim 13 wherein said spring member further comprises:

a member positioning spring arm abutting a stationary portion of said lock and biasing said spring member into a normal position of rest wherein said pair of parallel spaced spring arms normally straddle said abutment member when said bolt is in said locking position.

15. The combination lock of claim 14 wherein said actuator member is provided on said cam disc which revolves with said shaft to deflect said spring member and said lock comprising:

a rotatable rim and means for mounting said rim for an eccentric rotation relative said spring member whereby a randomly variable defection of said spring member is provided due to incremental rotation of said rim on each engagement with said spring member.

16. The combination lock of claim 15 wherein said spring member further comprises:

a follower arm positioned in the path of said actuator member to be engage thereby once upon each full rotation of said shaft.

17. A combination lock having a plurality of tumbler wheels manually rotatable by a combination dial and shaft associated therewith, each of said wheels having a fence receiving gate, a moveable lock bolt and a fence lever connected to said bolt and engageable with said shaft to move said bolt to an unlocking position when a fence associated with said fence lever is received in the aligned gates of said tumbler wheels, said lock comprising:

spring biasing means resiliently mounted within said lock to be operated from a normal rest position against the resiliency of its mounting to a defected position in response to each full rotation of said shaft, said biasing means having a first spring arm for biasing said fence toward said gates during deflective movement thereof to said deflected position and a second spring arm for biasing said fence away from said gates during movement from said deflected position to said normal rest position.

18. The combination lock of claim 17 wherein said lock includes an actuator member revolving with rotation of said shaft to engage said spring biasing means to move it to said deflected position and said actuator member comprises:

a mounting member fixed for revolving movement with rotation of said shaft; and an eccentric rim means provided for eccentric rotation about said mounting member to rotate slightly about said mounting member on each engagement with said spring biasing means to thereby provide a varying time of engagement between said actuator member and spring biasing means upon successive rotations of said shaft.

19. The combination lock of claim 17 wherein said spring biasing means comprises:

a one piece spring member having multiple spring arms formed integrally thereof including first and second parallel and spaced spring arms that alternately bias said fence toward and away form said gates as said spring biasing means is moved alternately to its deflected position and its normal rest position.

20. The combination lock of claim 17, wherein said lock includes means for biasing said bolt toward a locking position and wherein:

constraining means are provided for limiting movement of said fence away from said gates in an arcuate movement under the joint urging of the bias of said means for biasing said bolt and said spring biasing means.

21. The combination lock of claim 20 wherein said lock comprises:

detent means associated with said fence for engaging only one of said tumbler wheels as said fence undergoes said limiting movement to thereby scramble the alignment of said tumbler wheel gates as said bolt moves under its bias to said locking position.

22. A combination lock of claim 17 wherein said lock comprises:

actuator means operable in response to rotation of said shaft to bias said fence toward said gates once on each full rotation of said shaft; and eccentric means associated with said actuator means for varying the timing of the application of said bias to said fence during successive rotations of said shaft.

23. The combination lock of claim 22 wherein said actuator means includes a post mounted off center of the axis of rotation of said shaft and said eccentric means includes a rim eccentrically mounted to said post for eccentric rotation about said post.

24. The combination lock of claim 23 wherein said lock further comprises:

spring biasing means resiliently mounted within said lock to be operated from a normal rest position against the resiliency of its mounting to a deflected position in response to each full rotation of said shaft, said biasing means having a first spring arm for biasing said fence toward said gates during deflective movement thereof to said deflected position and a second spring arm for biasing said fence away from said gates during movement from said deflected position to said normal rest position.

* * * * *